US005939653A

United States Patent [19]

Chang

[11] Patent Number: 5,939,653

[45] Date of Patent: Aug. 17, 1999

[54] BRIDGE AND TREMOLO ARM ASSEMBLY FOR AN ELECTRIC GUITAR

[76] Inventor: I-Ping Chang, No 51, Shu-I 5th Lane, Taichung, Taiwan

[21] Appl. No.: 09/175,427

[22] Filed: Oct. 20, 1998

[51] Int. Cl.[6] ..... G10D 3/00

[52] U.S. Cl. ..... 84/313; 84/298; 84/299; 84/307

[58] Field of Search ..... 84/313, 298, 299, 84/307

[56] References Cited

U.S. PATENT DOCUMENTS

| | | | |
|---|---|---|---|
| 5,684,256 | 11/1997 | Rose | 84/314 N |
| 5,705,760 | 1/1998 | Rose | 84/298 |
| 5,747,713 | 5/1998 | Clement | 84/313 |
| 5,808,216 | 9/1998 | Fisher, IV | 84/313 |
| 5,847,297 | 12/1998 | Fisher, IV | 84/313 |

*Primary Examiner*—William M. Shoop, Jr.
*Assistant Examiner*—Kim Lockett
*Attorney, Agent, or Firm*—Bacon & Thomas

[57] ABSTRACT

A bridge and tremolo arm assembly for an electric guitar, including a bridge body mounted on a bottom block to hold a tremolo arm, a set of tension screw seats transversely adjustably mounted on the bridge body by screws, each tension screw seat having an elongated slot, which guides a respective string, a plurality of tension screw studs respectively mounted in respective vertical locating holes on the tension screw seats to support respective strings being guided out of the tension screw seats to the head of the electric guitar, and a plurality of adjustment nuts respectively mounted in respective horizontal slots at the tension screw seats and threaded onto the tension screw studs, the adjustment nuts being rotated to change the elevation of the respective tension screw studs in adjusting the tension of the respective strings.

2 Claims, 6 Drawing Sheets

BRIDGE AND TREMOLO ARM ASSEMBLY FOR AN ELECTRIC GUITAR

BACKGROUND OF THE INVENTION

The present invention relates to an electric guitar, and more particularly to a bridge and tremolo arm assembly for an electric guitar which can be convenient adjusted to change the elevation of tension screw studs in regulating the tension of the respective strings without causing the tension screw studs to vibrate.

An electric guitar, as shown in FIG. 1, comprises a bridge and tremolo arm assembly for controlling the tension of the strings. The bridge and tremolo arm assembly, as shown in FIG. 2, comprises a bridge body, a set of tension adjustment blocks horizontally vertically mounted on the bridge body for controlling the tension of the strings. Each tension adjustment block comprises two adjustment screws for elevation adjustment control. Because the elevation of each tension adjustment block is controlled by two adjustment screws, it is difficult to accurately adjust the two adjustment screws of each tension adjustment block to the same elevation. If the two adjustment screws are not accurately adjusted to the same elevation, the tension adjustment block cannot be maintained in a balanced manner, and a noise will be produced and picked up by the middle, treble or lead pick-up.

SUMMARY OF THE INVENTION

The present invention has been accomplished to provide a bridge and tremolo arm assembly for an electric guitar which eliminates the aforesaid problem. It is one object of the present invention to provide a bridge and tremolo arm assembly which can conveniently be operated to individually accurately adjust the tension of the strings. It is another object of the present invention to provide a bridge and tremolo arm assembly which is constantly maintained in a balanced manner so that no noise is produced when the electric guitar is played. According to one aspect of the present invention, the bridge and tremolo arm assembly comprises a bridge body mounted on a bottom block to hold a tremolo arm, a set of tension screw seats transversely adjustably mounted on the bridge body by screws, each tension screw seat having an elongated slot, which guides a respective string, a plurality of tension screw studs respectively mounted in respective vertical locating holes on the tension screw seats to support respective strings being guided out of the tension screw seats to the head of the electric guitar, and a plurality of adjustment nuts respectively mounted in respective horizontal slots at the tension screw seats and threaded onto the tension screw studs, the adjustment nuts being rotated to change the elevation of the respective tension screw studs in adjusting the tension of the respective strings without any tool. According to another aspect of the present invention, the tension screw seats each have a locating flange inserted into a respective transverse slot on the bridge body, therefore the tension screw seats do not vibrate nor make any noise when they are horizontally adjusted.

DETAILED DESCRIPTION OF THE PREFERRED EMBODIMENT

Figure 1:
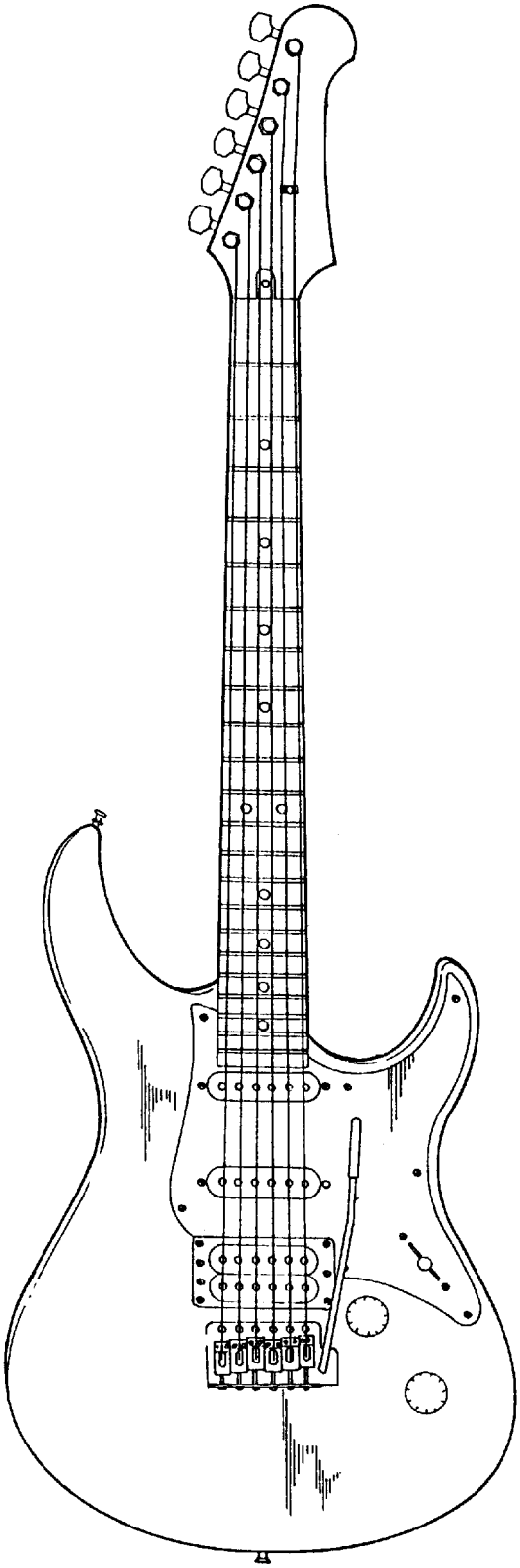
Fig.1 PRIOR ART
FIG. 1 is a plain view of a regular electric guitar.
Figure 2:
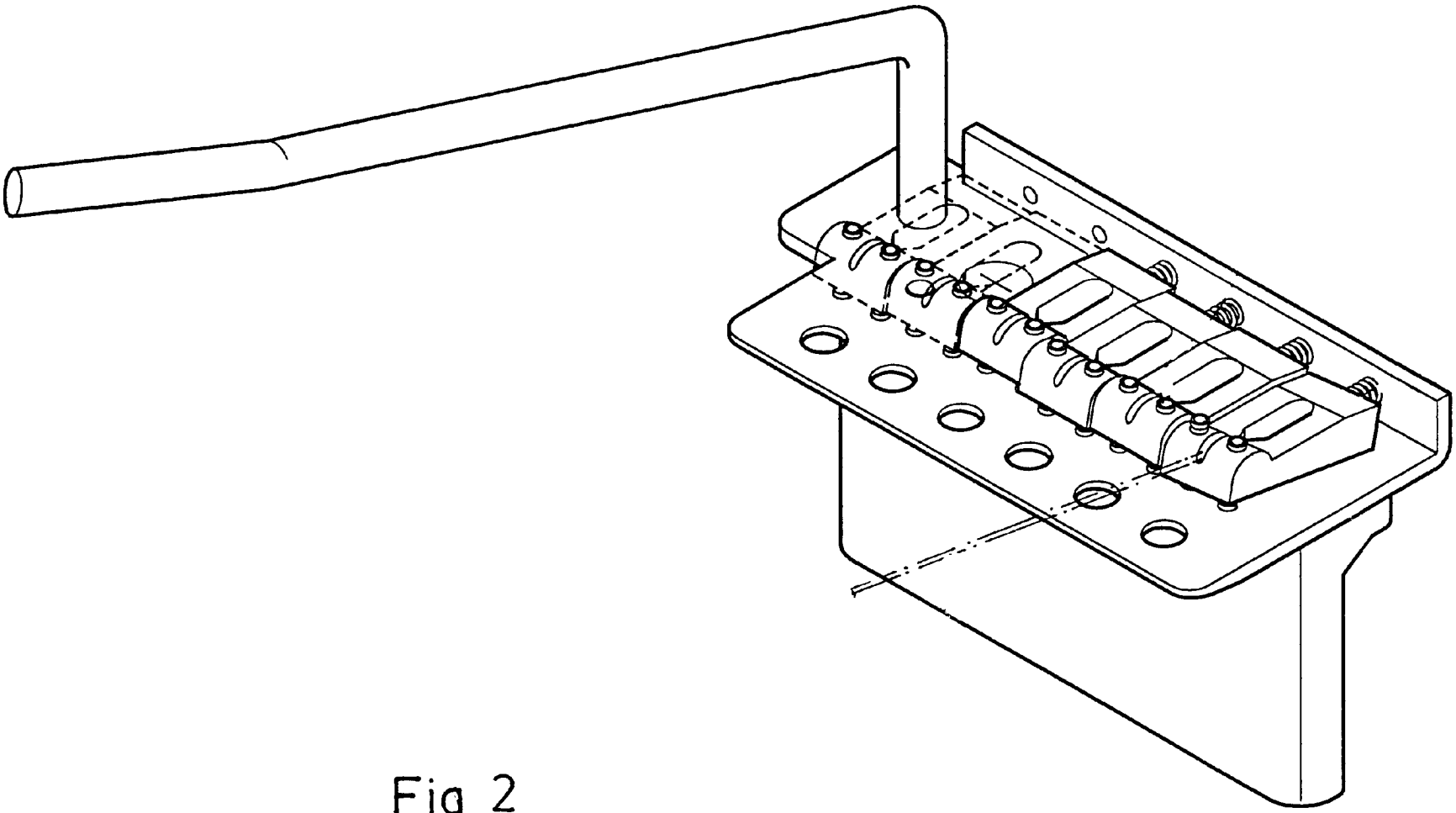
Fig. 2 PRIOR ART
FIG. 2 is a perspective view of a bridge and tremolo arm assembly for an electric guitar according to the prior art.
Figure 3:
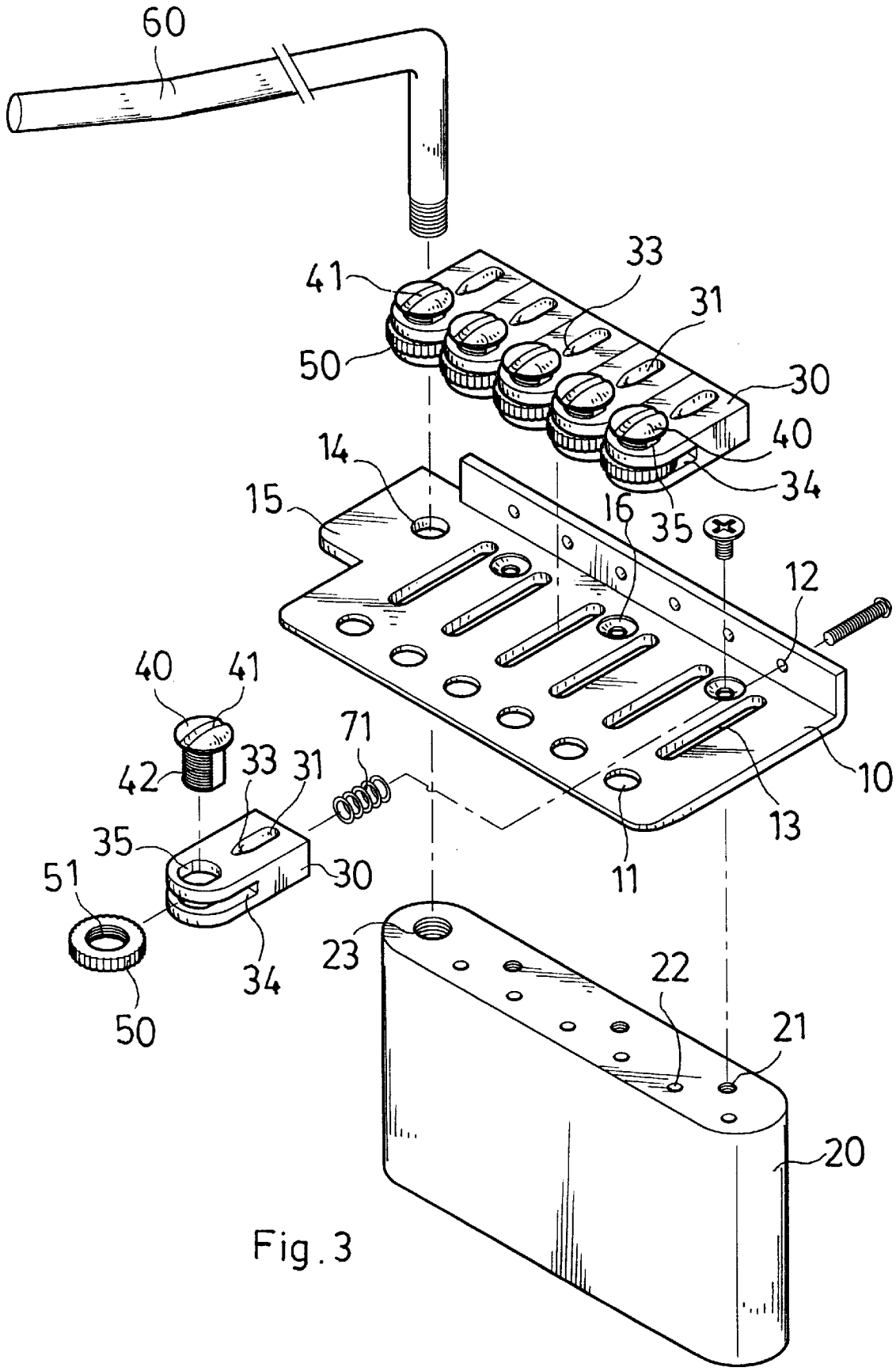
FIG. 3 is an exploded view of a bridge and tremolo arm assembly for an electric guitar according to the prior art.

Referring to FIGS. from 3 through 6, a bridge and tremolo arm assembly for an electric guitar is shown comprised of a bridge body 10, a bottom block 20, a plurality of tension screw seats 30, a plurality of tension screw studs 40, a plurality of adjustment nuts 50, and a tremolo arm 60.

The bridge body 10 is a flat, substantially L-shaped frame, comprising a row of round holes 11 longitudinally arranged along one side of the horizontal side wall thereof, a row of through holes 12 arranged on the vertical side wall thereof corresponding to the round holes 11, a plurality of transverse slots 13 arranged in parallel between the round holes 11 and the through holes 12, an extension plate 15 longitudinally extended from one end of the horizontal side wall, a through hole 14 at the extension plate 15, and a plurality of countersunk holes 16 longitudinally arranged along one side of the horizontal side wall in parallel to and remove from the round holes 11 and spaced from one another by the transverse slots 13.

The bottom block 20 is provided to support the bridge body 10, having a plurality of screw holes 21 respectively fastened to the countersunk holes 16 at the bottom side of the bridge body 10 by screws, a plurality of stepped string mounting holes 22 through top and bottom sides thereof corresponding to the transverse slots 13 on the bridge body 10, which receive a respective string 70 (see FIG. 5), and a screw hole 23 corresponding to the through hole 14 on the projecting portion 15 of the bridge body 10.

Figure 6:
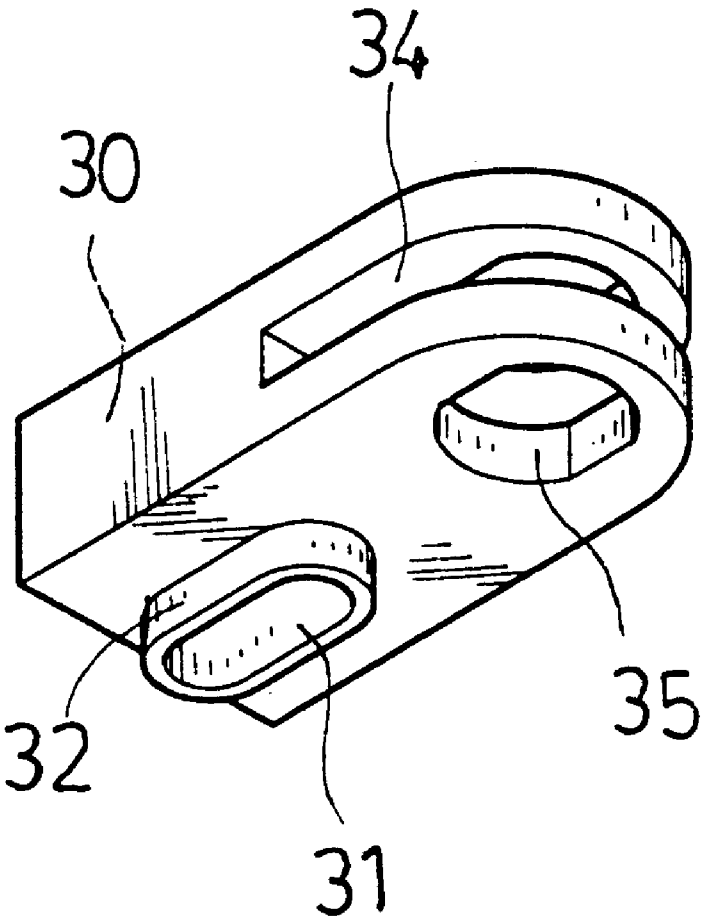
FIG. 6 is a perspective of a tension screw seat according to the present invention.

The tension screw seats 30 are respectively mounted on the bridge body 10 and connected to the through holes 12 on the vertical side wall of the bridge body 10. Each tension screw seat 30 comprises an elongated slot 31 disposed in vertical alignment with one transverse slot 13 on the bridge body 10 to guide one string 70, a locating flange 32 raised from the bottom side wall around the elongated slot 31 (see FIG. 6) and moved with the respective tension screw seat 30 back and forth along the corresponding transverse slot 13, a smoothly curved string guide edge 33 at the front end of the elongated slot 31 that guides the respective string 70 out of the elongated slot 31, a non-circular vertical locating hole 35 at the front end, a horizontal slot 34 at the front end across the vertical locating hole 35, and a horizontal screw hole 36 at the rear end connected to one through hole 12 on the vertical side wall of the bridge body 10 by a respective screw 17. A compression spring 71 is retained between the vertical side wall of the bridge body 10 and each tension screw seat 30 around the respective screw 17, which fastens the respective tension screw seat 30 to the respective through hole 12 on the vertical side wall of the bridge body 10.

The tension screw studs 40 are respectively mounted in the vertical locating holes 35 of the tension screw seats 30, each comprising a round head with a string groove 41, which guides one string 70 (see FIG. 5), a threaded, non-circular stem 42 fitting the vertical locating hole 35 of one tension screw seat 30, and an axial bottom hole 43, which receives one piezoelectric ceramic element 72 tending to increase sound.

The adjustment nuts 50 are respectively mounted in the horizontal slots 34 of the tension screw seats 30, each having a center screw hole 51 respectively threaded on the threaded, non-circular stems 42 of the tension screw studs 40.

The tremolo arm 60 is mounted in the through hole 14 at the extension plate 15 of the bridge body 10, and threaded into the screw hole 23 on the bottom block 20.

Figure 4:
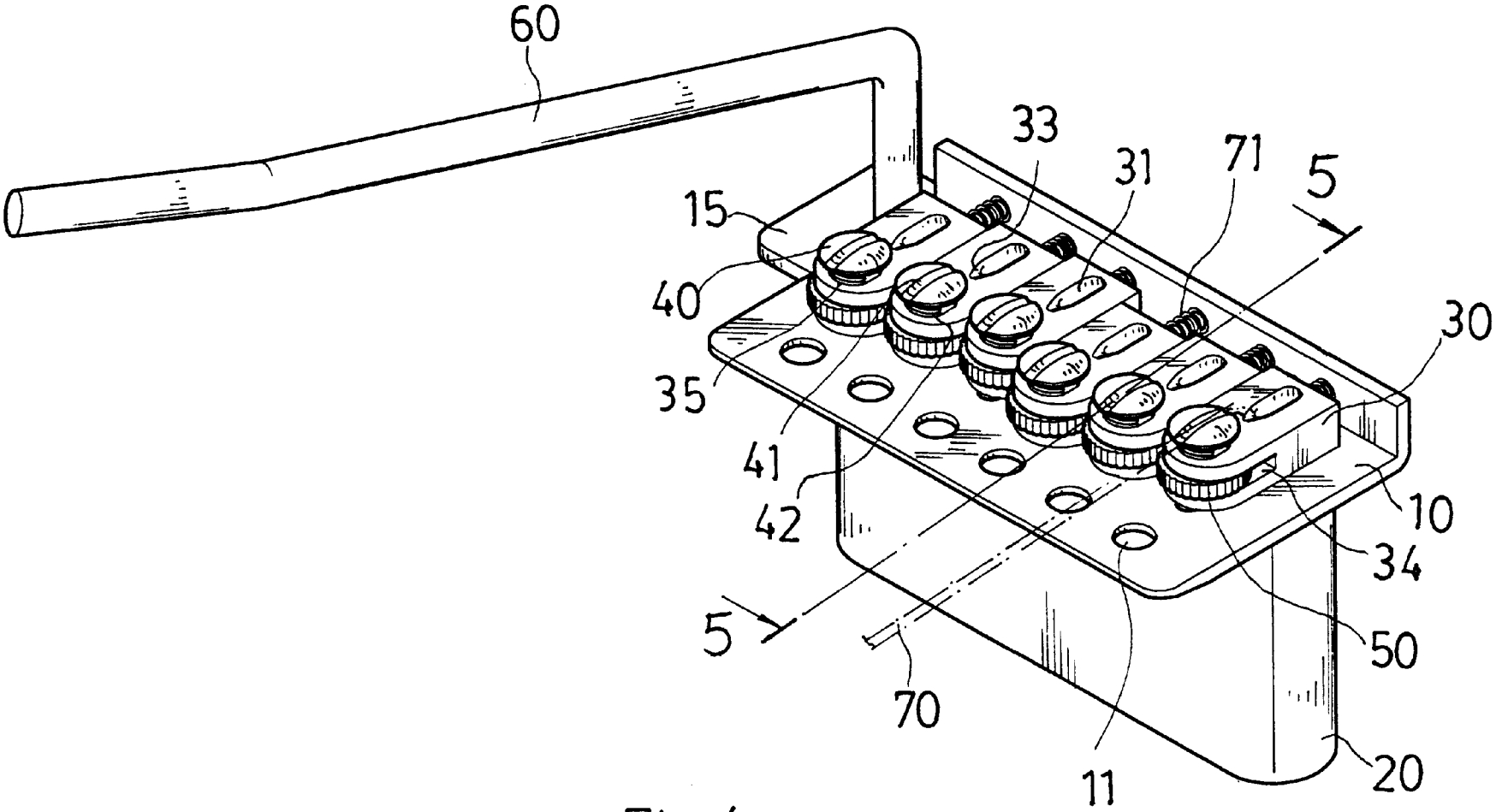
FIG. 4 is a perspective assembly view of the bridge and tremolo arm assembly shown in FIG. 3.
Figure 5:
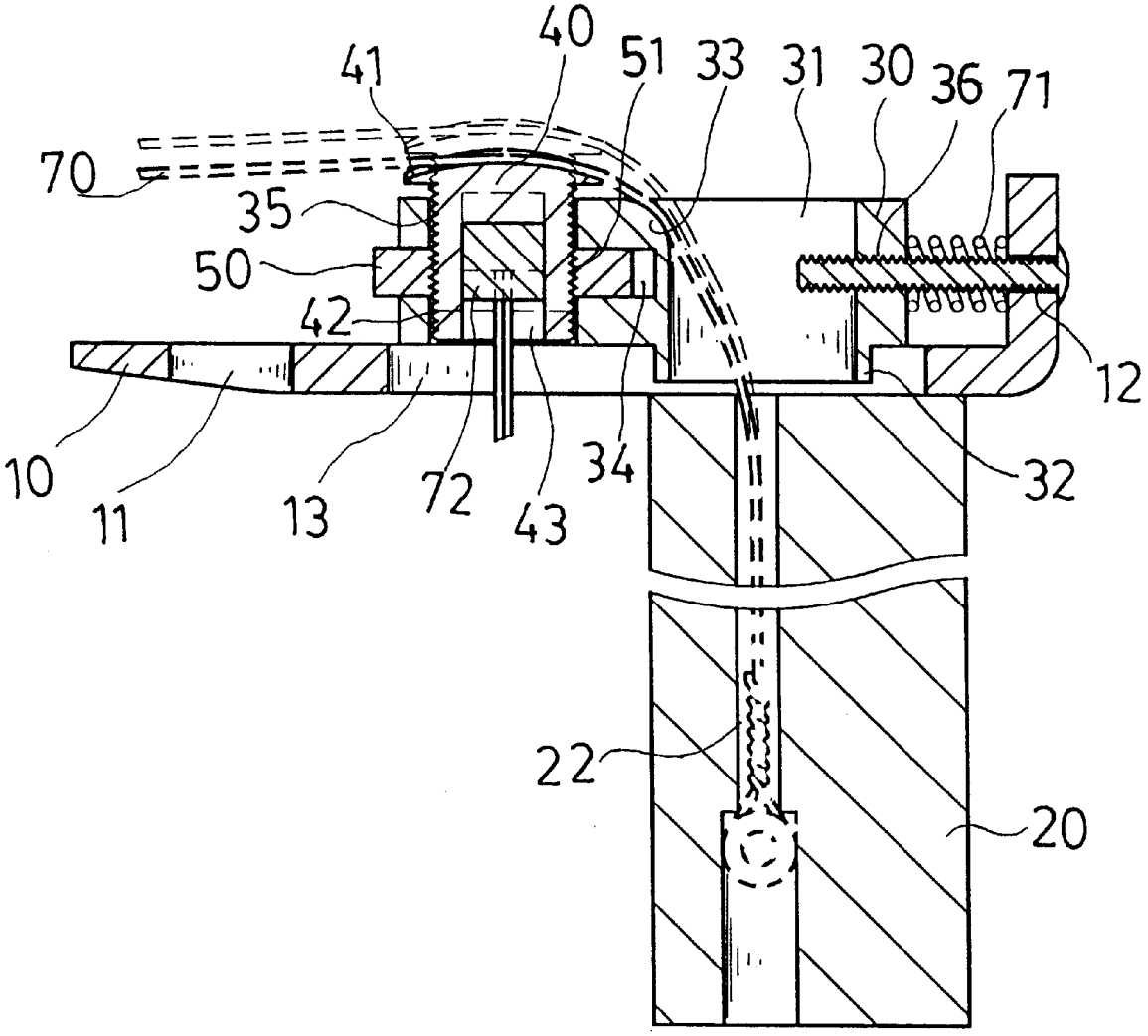
FIG. 5 is a sectional view taken along line 5—5 of FIG. 4.

Referring to FIGS. 4 and 5, strings 70 are respectively mounted in the string mounting holes 22 on the bottom block 20, then extended upwards through the transverse slots 13 on the bridge body 10 and the elongated slots 31 of the tension screw seats 30, and then guided outwards toward the head of the electric guitar by the smoothly curved string guide edges 33 at the elongated slots 31 and the grooves 41 at the round heads of the tension screw studs 40.

Referring to FIG. 5 again, the tension screw seats 30 can respectively be moved back and forth along the transverse slots 13 on the bridge body 10 to the desired position by turning the respective screws 17, and the elevation of the tension screw studs 40 can respectively adjusted by turning the respective adjustment nuts 50. By means of adjusting the positions of the tension screw seats 30 on the bridge body 10 and the elevational positions of the tension screw studs 40 on the tension screw seats 30, the tension of the strings 70 is respectively adjusted. Because the threaded stem 42 of the tension screw studs 40 are non circular, and fit the non-circular vertical locating holes 35 of the tension screw seats 30, the tension screw studs 40 are constantly firmly retained in vertical.

What is claimed is:

1. A bridge and tremolo arm assembly for an electric guitar, comprising:

a bottom block, said bottom block comprising a plurality of screw holes, a row of stepped string mounting holes through top and bottom sides thereof for holding a string each, and a threaded tremolo arm mounting hole;

a bridge body supported on said bottom block, said bridge body comprising a horizontal wall and a vertical wall connected at right angles, a row of round holes respectively vertically aligned with the stepped string mounting holes of said bottom block for guiding strings out of the stepped string mounting holes of said bottom block, a row of tension screw seat mounting holes arranged on the vertical side wall corresponding to said round holes, a plurality of transverse slots arranged in parallel between said round holes and said tension screw seat mounting holes, an extension plate longitudinally extended from one end of the horizontal side wall, a through hole at said extension plate, and a plurality of countersunk holes respectively fastened to the screw holes on said bottom block by respective screws;

a tremolo arm mounted in the through hole at said extension plate of said bridge body and threaded into the threaded tremolo arm mounting hole on said bottom block;

a plurality of tension screw seats respectively mounted on said bridge body and connected to the tension screw seat mounting holes on the vertical side wall of said bridge body, said tension screw seats each comprising a front end, a rear end, a bottom side wall, an elongated slot adjacent to the rear end, which guides a string out of one transverse slot on said bridge body, a locating flange raised from its bottom side wall around said elongated slot and moved with the respective tension screw seat back and forth along the corresponding transverse slot on said bridge body, a non-circular vertical locating hole near its front end, a horizontal slot at its front end across said vertical locating hole, and a horizontal screw hole at its rear end connected to one tension screw seat mounting hole on the vertical side wall of said bridge body;

a plurality of tension screw seat mounting screws respectively mounted in the tension screw seat mounting holes on the vertical side wall of said bridge body and threaded into the horizontal screw holes at the rear ends of said tension screw seats;

a plurality of springs respectively mounted around said tension screw seat mounting screws and stopped between the vertical side wall of said bridge body and the rear ends of said tension screw seats;

a plurality of tension screw studs respectively mounted in the vertical locating holes of said tension screw seats, said tension screw studs each comprising a round head, a string groove at said round head for guiding one string from the elongated slot of one tension screw seat, and a threaded, non-circular stem fitting the vertical locating hole on one tension screw seat; and a plurality of adjustment nuts respectively mounted in the horizontal slots of said tension screw seats and threaded onto the threaded, non-circular stem of said tension screw studs.

2. The bridge and tremolo arm assembly of claim 1 wherein the elongated slot of each of said tension screw seats has a smoothly curved string guide edge for guiding a respective string out of the respective tension screw seat.

* * * * *